US009447617B2

(12) United States Patent
Smith

(10) Patent No.: US 9,447,617 B2
(45) Date of Patent: Sep. 20, 2016

(54) SLIDING DOOR PANEL HOLD OPEN ASSEMBLY

(75) Inventor: Gary R. Smith, Hatfield, PA (US)

(73) Assignee: Overhead Door Corporation, Lewisville, TX (US)

( * ) Notice: Subject to any disclaimer, the term of this patent is extended or adjusted under 35 U.S.C. 154(b) by 0 days.

(21) Appl. No.: 13/189,117

(22) Filed: Jul. 22, 2011

(65) Prior Publication Data

US 2013/0020815 A1 Jan. 24, 2013

(51) Int. Cl.

| | |
|---|---|
| ***E05C 17/56*** | (2006.01) |
| ***E05C 19/16*** | (2006.01) |
| ***E05C 17/60*** | (2006.01) |
| *E05C 19/18* | (2006.01) |
| *E05C 17/44* | (2006.01) |
| *E05F 5/02* | (2006.01) |
| *E05C 17/54* | (2006.01) |

(52) U.S. Cl.

CPC ..... *E05C 17/60* (2013.01); *E05C 17/56* (2013.01); *E05C 17/54* (2013.01); *E05C 19/16* (2013.01); *Y10T 292/11* (2015.04); *Y10T 292/282* (2015.04)

(58) Field of Classification Search

CPC ..... Y10T 292/11; E05B 15/0073; E05B 17/2015; E05B 2015/1692; E05B 65/0894; E05C 17/56; E05C 19/16; E05C 19/161; E05C 19/163; E05C 19/165; E05C 19/166; E05C 19/168; E05C 17/025; E05C 17/047; E05C 17/54; E05C 19/007; E05C 19/008

USPC ..... 292/251.5, DIG. 21, DIG. 46, 1, 342, 292/288, 290, 292, 295, DIG. 15, DIG. 19; 16/82, 86 A; 49/118, 139, 449, 364, 49/379

See application file for complete search history.

(56) References Cited

U.S. PATENT DOCUMENTS

| | | | | | |
|---|---|---|---|---|---|
| 722,007 | A * | 3/1903 | Fulton | E05B 85/24 | 292/44 |
| 1,858,886 | A * | 5/1932 | Deguenther | E05F 5/06 | 16/85 |
| 2,080,656 | A * | 5/1937 | De Vries | A47B 95/02 | 16/414 |
| 2,468,969 | A * | 5/1949 | Galey | E05C 17/446 | 292/144 |
| 2,584,480 | A * | 2/1952 | Manting | E05C 19/166 | 109/63.5 |
| 2,651,817 | A * | 9/1953 | Moler | E05D 13/006 | 16/82 |
| 2,815,236 | A * | 12/1957 | Lowinski | E05C 17/56 | 292/251.5 |
| 2,869,171 | A * | 1/1959 | Levine | E05F 5/003 | 16/83 |
| 3,025,559 | A * | 3/1962 | Basinger | E05C 17/56 | 16/85 |

(Continued)

FOREIGN PATENT DOCUMENTS

| | | | | |
|---|---|---|---|---|
| JP | 53036399 A * | 4/1978 | | |
| WO | WO 9000663 A1 * | 1/1990 | | E05D 5/10 |

*Primary Examiner* — Kristina Fulton
*Assistant Examiner* — Faria Ahmad
(74) *Attorney, Agent, or Firm* — Gardere Wynne Sewell LLP

(57) ABSTRACT

A sliding door panel and assembly is described, such that when in the door panel is in an open arrangement there is a functional cooperation or coupling between at least a first unit and a second unit of the assembly. The second unit is generally affixed to the sliding door and the first unit is fixedly mounted with a sliding door guide system or to a header/footer or frame. A third unit may be included with the assembly such that when the sliding door panel is positioned in the open arrangement, the third unit limits engagement between the first and second units. In addition, the third unit is positioned to limit linear movement of a slideable portion of the first unit thereby preventing damage.

23 Claims, 5 Drawing Sheets

(56) References Cited

U.S. PATENT DOCUMENTS 3,163,453 A * 12/1964 Stephens ..... E05C 17/56 292/251.5
3,244,443 A * 4/1966 Rodgers ..... E05C 17/56 16/82
3,261,631 A * 7/1966 Alessi ..... E05C 17/56 292/251.5
3,404,501 A * 10/1968 Von Wedel ..... E06B 3/5409 52/126.4
3,471,189 A * 10/1969 Ness ..... E05B 65/0888 292/251.5
3,516,701 A * 6/1970 Graham ..... E05C 19/163 292/144
3,539,214 A * 11/1970 Fisher ..... E05C 19/16 292/144
3,578,370 A * 5/1971 Greytok ..... E05C 17/56 16/86 A
RE27,161 E * 8/1971 Raymon ..... E05B 65/0888 292/262
3,648,326 A * 3/1972 Gaysowski ..... E05F 3/222 16/48.5
3,661,413 A * 5/1972 Silva ..... E05D 13/04 16/82
3,691,688 A * 9/1972 Kaiserswerth ..... H05K 9/0015 174/371
3,701,557 A * 10/1972 James Vincent ..... E05C 17/56 16/86 A
3,714,738 A * 2/1973 Koslow ..... E05D 13/06 49/404
3,827,019 A * 7/1974 Serbu ..... A41F 1/002 135/117
3,935,614 A * 2/1976 Pannone ..... A62C 2/247 16/48.5
3,964,125 A * 6/1976 Tansley ..... A62C 2/06 16/48.5
4,040,143 A * 8/1977 Lasier ..... E05F 3/222 16/48.5
4,054,308 A * 10/1977 Prohaska ..... E05B 65/0829 292/204
4,089,083 A * 5/1978 Wilde ..... E05F 5/02 16/82
4,102,004 A * 7/1978 Nagase ..... E05F 3/102 16/49
4,126,912 A * 11/1978 Johnson ..... E05D 15/0665 16/105
4,142,326 A * 3/1979 Schmitz ..... E05F 15/655 49/118
4,155,576 A * 5/1979 Kennon ..... E05C 19/16 16/82
4,167,835 A * 9/1979 Nobes ..... E05C 1/10 292/175
4,183,179 A * 1/1980 Gutridge ..... E05D 15/0656 16/85
D274,980 S * 8/1984 Tomita ..... D8/402
4,491,355 A * 1/1985 Marinoni ..... E05C 17/34 16/332
4,505,502 A * 3/1985 Tomita ..... E05C 17/56 16/320
4,669,766 A * 6/1987 Hanchett, Jr. ..... E05C 17/56 292/251.5
4,678,213 A * 7/1987 Brasuell ..... E05C 9/02 292/170
4,696,500 A * 9/1987 Zunkel ..... E05C 17/56 292/251.5
4,702,506 A * 10/1987 Iimura ..... E05C 19/165 292/251.5
4,852,919 A * 8/1989 Nimee ..... E05C 17/56 16/82
4,995,655 A * 2/1991 Freeman ..... E05C 17/56 292/251.5
5,010,622 A * 4/1991 Morita ..... E05C 17/56 16/82
5,082,317 A * 1/1992 Delaney, Jr. ..... E05C 17/56 292/251.5
5,139,293 A * 8/1992 Zimmerman ..... E05C 17/56 292/251.5
5,274,889 A * 1/1994 Morita ..... A41F 1/002 24/303
5,499,517 A * 3/1996 McCraw ..... E05B 65/0007 16/86 R
5,758,453 A * 6/1998 Inage ..... E05F 15/60 49/118
5,782,512 A * 7/1998 Cargnoni ..... E05C 19/16 292/251.5
5,809,613 A * 9/1998 Baines ..... E05C 17/46 16/82
5,887,917 A * 3/1999 Luciana ..... E05C 17/56 16/82
6,167,589 B1 * 1/2001 Luedtke ..... E05F 1/00 16/49
6,499,185 B1 * 12/2002 Moyer ..... E05F 3/222 16/51
6,588,811 B1 * 7/2003 Ferguson ..... E05B 1/0007 16/320
6,658,697 B2 * 12/2003 Liao ..... E05F 5/02 16/82
6,712,406 B2 * 3/2004 Stojc ..... B60J 5/062 292/144
7,267,378 B2 * 9/2007 Drumm ..... E05C 19/163 292/251.5
7,815,232 B2 * 10/2010 Henry ..... B60J 10/244 292/251.5
7,819,441 B1 * 10/2010 Coman ..... E05C 17/56 16/82
8,136,299 B2 * 3/2012 Inage ..... B61D 19/005 292/251.5
8,567,831 B2 * 10/2013 Roti ..... E05C 17/56 16/82
8,826,598 B2 * 9/2014 Ranaudo ..... E05B 65/08 49/506
8,931,139 B2 * 1/2015 Saito ..... E05F 1/16 16/49
2001/0030606 A1 * 10/2001 Jaffe ..... F25D 23/021 340/545.6
2003/0126797 A1 * 7/2003 Inage ..... B61D 19/02 49/118
2003/0218541 A1 * 11/2003 Sakai ..... G08B 13/126 340/545.1
2004/0010886 A1 * 1/2004 Eldh ..... E05C 17/28 16/49
2004/0098915 A1 * 5/2004 Baldry ..... E05B 17/0029 49/339
2004/0104584 A1 * 6/2004 Ferguson ..... E05B 1/0007 292/251.5
2004/0148733 A1 * 8/2004 Wartian ..... E05C 17/30 16/66
2005/0212304 A1 * 9/2005 Herrera ..... B60J 10/244 292/251.5
2005/0274078 A1 * 12/2005 Gilchrist ..... E05F 15/42 49/360
2006/0049645 A1 * 3/2006 Drumm ..... E05C 19/163 292/251.5
2007/0052248 A1 * 3/2007 Gosch ..... E05F 3/222 292/144
2007/0186481 A1 * 8/2007 Tomita ..... A47B 88/0477 49/409
2008/0250716 A1 * 10/2008 Ranaudo ..... E05B 65/08 49/31
2009/0126279 A1 * 5/2009 Kopish ..... E05D 15/1042 49/409
2010/0123323 A1 * 5/2010 Geringer ..... E05B 47/0012 292/164
2010/0162523 A1 * 7/2010 Ferguson ..... E05C 17/56 16/82
2010/0188177 A1 * 7/2010 Inage ..... B61D 19/005 335/205
2011/0049911 A1 * 3/2011 Bosshard ..... E05C 17/56 292/251.5
2011/0101711 A1 * 5/2011 Della-Santa ..... E05C 17/02 292/251.5
2012/0192493 A1 * 8/2012 Wolfe ..... E05B 47/0046 49/449
2012/0272482 A1 * 11/2012 Evans ..... E05F 5/06 16/86 R

* cited by examiner

SLIDING DOOR PANEL HOLD OPEN ASSEMBLY

BACKGROUND

1. Technical Field

The present invention relates to door systems, and more particularly, to hold open devices for retaining a door system in an open position.

2. Introduction

Conventional sliding door systems typically include one or more sliding doors mounted in a track directing movement of the sliding doors between an open and closed position. During operation, sliding doors are commonly retained in the open position by hold open assemblies, which are typically rigidly attached to the sliding door and door frame. However, in the event a door is abruptly opened, movement of the sliding door can potentially damage the hold open assembly. For example, in the event the door is abruptly moved to the open position, excessive force on the door can cause components in the hold open assembly to bend and/or break thereby potentially rendering the hold open assembly inoperable. It is therefore the principal purpose of this invention to avoid these and other disadvantages of existing door systems.

SUMMARY

In the embodiments described herein, a hold open assembly is operable to hold a sliding door panel in an open arrangement by way of a functional cooperation or magnetic coupling between a pair of floating plates. A first floating plate/element is generally affixed to the sliding door and a second floating plate slideably secured to a base assembly disposed on a stationary structure, such as a door guide, header/footer or a door frame. In operation, when the sliding door is transitioned to a fully open position, magnetic contact between the floating plates enables the door to be held open until a user provides sufficient force to overcome the magnetic attraction, at which time the door will be released from the open position. Preferably, a door stop is utilized to limit the distance of travel of the sliding door panel to prevent and/or otherwise limit the likelihood of damage to the hold open assembly (i.e., breaking, cracking, bending, or dislodging of floating plates and/or the structure supporting the floating plates). In particular, hold open assembly is mounted at position allowing contact between the floating plates just prior to a leading edge of the door panel contacting the stop. If excessive force is used to move the door and the door continues to move after contact between the plates of the hold open assembly, the base assembly enables continued movement of the floating plates (and thus the door) until the door contacts and is stopped by the door stop. Thus, the sliding movement of the hold open assembly coupled with the use of a door stop prevents unintended damage to the hold open assembly during situations of excessive force or door movement.

Those skilled in the art will further appreciate the above-mentioned advantages and superior features of the invention together with other important aspects thereof upon reading the detailed description which follows in conjunction with the drawings.

BRIEF DESCRIPTION OF THE DRAWINGS

For more complete understanding of the features and advantages of the inventions described herein, reference is now made to a description of the invention along with accompanying figures, wherein.

DETAILED DESCRIPTION

Figure 1:
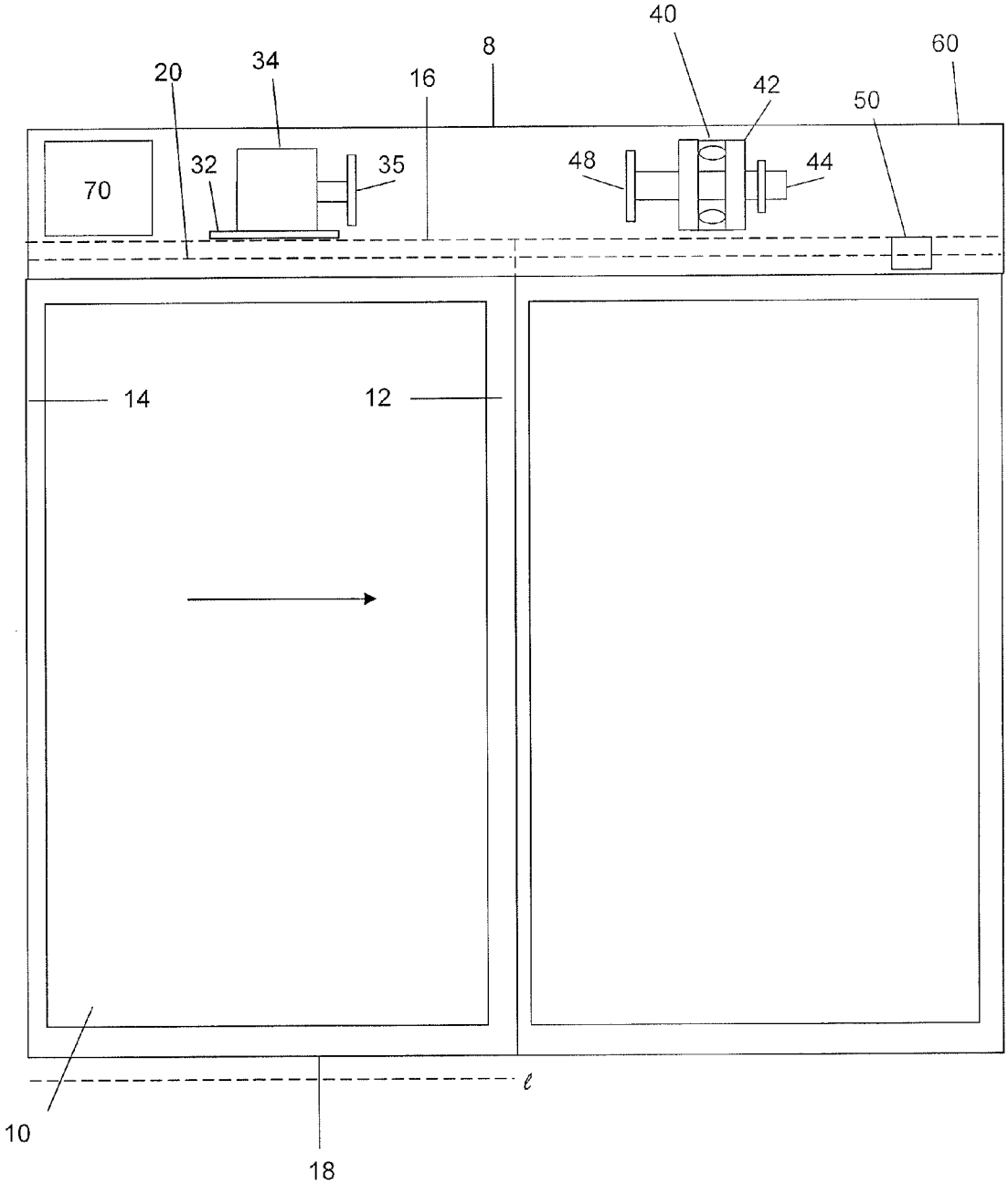
FIG. 1 is a front view of a representative door panel and hold open assembly with the door panels in a closed position.

Although making and using various embodiments are discussed in detail below, it should be appreciated that as described herein are provided many inventive concepts that may be embodied in a wide variety of contexts. Embodiments discussed herein are merely representative and do not limit the scope of the invention.

The drawing figures are not necessarily to scale and certain features may not be shown or may be exaggerated in scale or in somewhat generalized or schematic form in the interest of clarity and conciseness. In the following description, like numbers refer to like elements.

Figure 4:
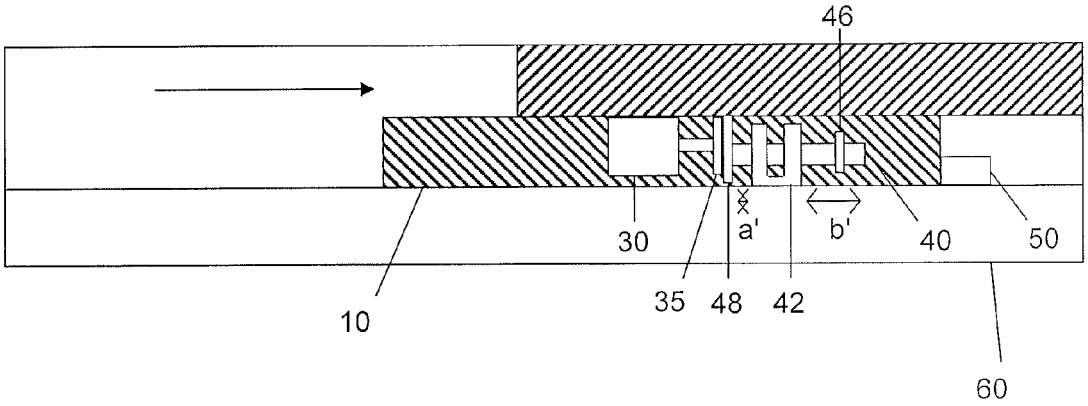
FIG. 4 is a top view of the door panel and hold open assembly illustrated in FIG. 3.
Figure 3:
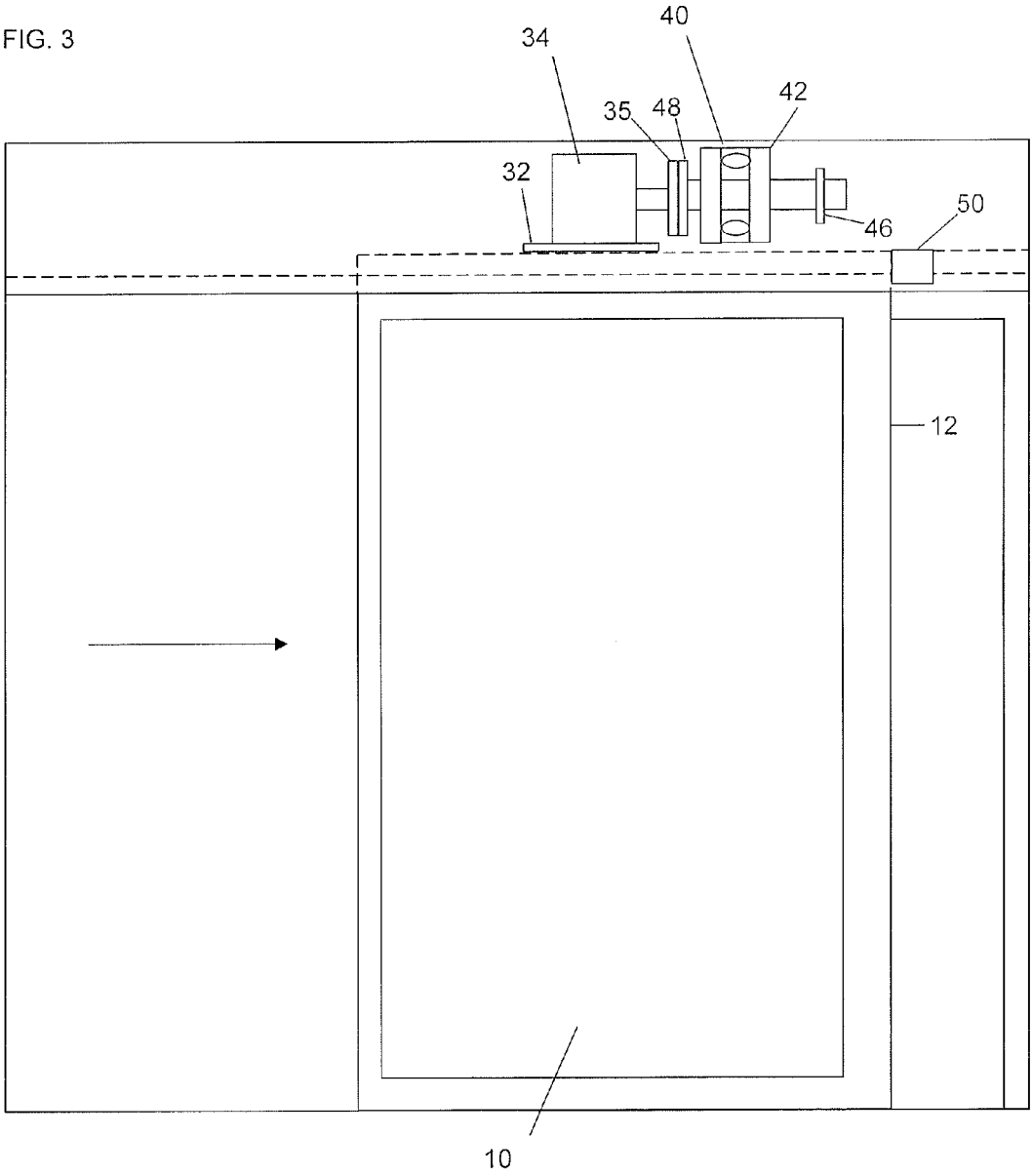
FIG. 3 is a front view of the door panel and hold open assembly of FIG. 1 in the open position.

Described herein is a door hold open assembly 8 for retaining a sliding door panel 10 in an open position. In the embodiment illustrated in FIG. 1 and as discussed in further detail below, hold open assembly 8 comprises a floating element/plate 35 secured to sliding door panel 10 and cooperable with a corresponding magnetic floating element/plate 48 that is disposed on a stationary base assembly 40, both operable to retain door panel 10 in the open position (FIGS. 3 and 4). According to embodiments disclosed herein, base member 40 comprises a laterally movable piston 44 that supports floating plate 48 to allow for, as discussed in greater detail below, a flexible and non-rigid engagement between floating plate 35 and floating plate 48 as floating plate 35 approaches plate 48 when door 10 is moved to the open position. Embodiments disclosed herein are designed to minimize and/or otherwise eliminate potential damage to hold open assembly 8 as door panel 10 is moved to the open position.

In the embodiment illustrated in FIGS. 1-4, door panel 10 is movable within a guide system 20 and is operable between a closed position (FIG. 1) and an open position (FIG. 3). Door panel 10 may be described as having a leading edge 12 for contacting a stop member 50 in order to limit door travel, a trailing edge 14, a top 16 and a bottom 18. In various embodiments, the door may further comprise horizontal and vertical stiles, which may form a frame, or a door panel described herein may have a separate frame.

In FIGS. 1-4, door panel 10 is illustrated to be movable along a linear trajectory and is generally guided by panel guide system 20; however, it should be understood that non-linear movement of door panel 10, such as in an arc or other path, may be utilized. Furthermore, movement of door panel 10 may be in the horizontal direction (as illustrated), the vertical/upward direction or in an angled direction and may be operated manually or with a mechanically or motor driven operator 70 (FIG. 1). In addition, while panel guide system 20 is depicted in FIG. 1 as positioned on the upper end of door panel 10, guide system 20 may also be positioned above door panel 10, on the lower end of door panel 10, below door panel 10 or any suitable combination thereof.

Figure 5B:
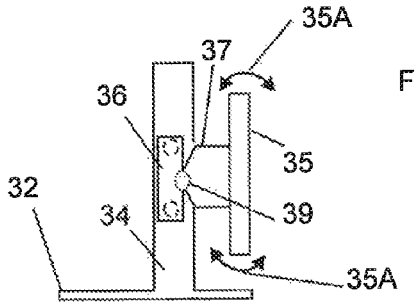
FIGS. 5A and 5B are representative schematics of a portion of the hold open assembly illustrated in FIGS. 1-4.
Figure 5A:
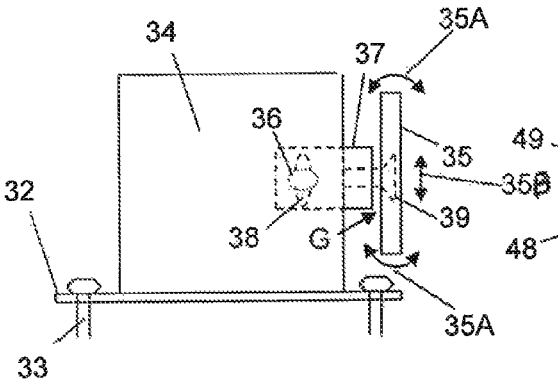

Referring to FIGS. 1-5A, floating plate 35 is mounted to door panel 10 via a base member 32, which is secured to door panel 10 via one or more fasteners 33 (FIG. 5A). A support body/plate 34 is mounted to and extends from base 32, which may be fixedly secured to base 32 or integral therewith. Furthermore, body 34 may be configured to support additional features that are not illustrated, such as, for example, connecting elements and/or an end of a door cable that is operable with a mechanical or motor-driven operator 70 to move door panel 10 between the open and closed positions.

Connected to body 34 is a subassembly that allows movement of plate 35 relative to support body/plate 34, the movement being depicted by arrows 35A (FIG. 5A). In one form, the subassembly comprises floating plate 35 pivotably disposed on a mounting element 37. In particular, floating plate 35 fixedly but not rigidly secured to element 37 by way of a fastener 39, which is tightened a sufficient amount to provide a gap G between floating plate 35 and the end of mounting element 37. This enables a pivoting motion of floating plate 35 with respect to mounting element 37 and thus, plate 34, to enable plate 35 to rest flush against plate 48 in the event door 10 is tilted or otherwise angled that would otherwise prevent flush alignment of plates 35 and 48. Referring specifically to FIG. 5A, in some embodiments, the position of mounting element 37 may be adjusted within a slot 38 to allow movement in the direction indicated by arrows 35B. This facilitates alignment of floating plate 35 with corresponding floating plate 48 of base assembly 40 such that they are aligned in a common trajectory. Alternatively and referring specifically to FIG. 5B, floating plate 35 may be connected to body 34 by a semi-spherical slip/ball joint 39 disposed on or otherwise within support body 34. While not illustrated herein, mounting element 37 may be retractable, having, for example, a telescoping means, generally in a more extended position when the door panel is in the closed position, and/or mounting element 37 may be combined and cooperative with a means for absorbing mechanical force, such as a shock absorber.

Figure 6:
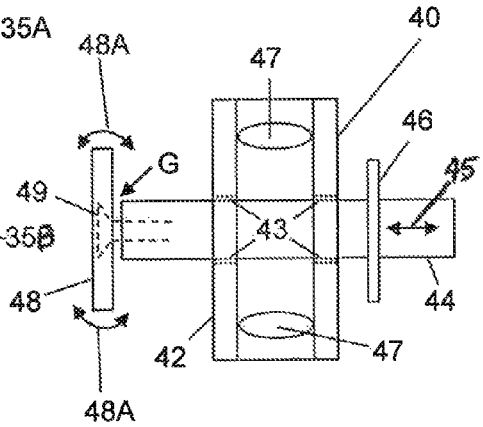
FIG. 6 is a representative top view of separate portion of the hold open assembly illustrated in FIGS. 1-4.
Figure 8:
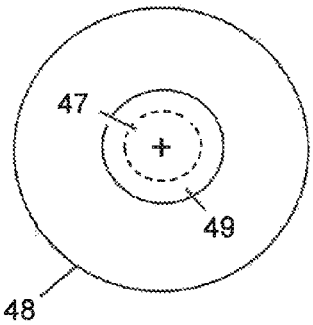
FIG. 8 is a representative front view of the floating plates illustrated in FIG. 6 or 7.
Figure 7:
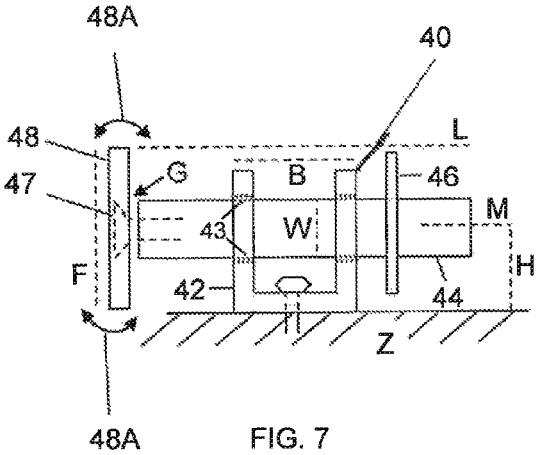
FIG. 7 is a representative side view of the portion of the hold open assembly illustrated in FIG. 6.

Referring now to FIGS. 6 and 7, base assembly 40 is shown to generally comprise a mounting unit or bracket 42, a piston 44, a retainer ring 46 and floating element/plate 48. Piston 44 is sized and shaped for positioning within an opening 43 of bracket 42. The piston is elongated so that its length (see dashed line, L, FIG. 7) is significantly greater than its width (W) or cross-sectional diameter. The width of piston 44 is generally constant along its entire length. In cross section, the piston may be of any shape, such as circular, oval, rectangular, square, polygonal, and variations, thereof. Openings 43 are generally sized and shaped to cooperate with piston 44 and its shape, allowing movement of piston 44 within opening 43, said movement being of relative ease and with little resistance and taking place along the length of piston 44, generally in the direction of arrow 45. The movement may be further augmented with use of a lubricant or material that assists in ease of movement. Retainer ring 46, located near a first end of piston 44, prevents piston 44 from separating from bracket 42. Floating plate 48 is located at a second and opposing end of the piston and is fixedly but not rigidly secured to piston 44 by way of a fastener 49. For example, fastener 49 is tightened a sufficient amount to provide a gap G between floating plate 48 and the second end of piston 44 to enable a pivoting motion in the direction of arrows 48A of the floating plate with respect to piston 44. Other means for securing floating plate 48 to piston 44 are also suitable. For example, a means, such as depicted in FIG. 5B that includes a slip joint may be used in connection with floating plate 48 in order to allow movement of floating plate 48 relative to piston 44.

Figure 2:
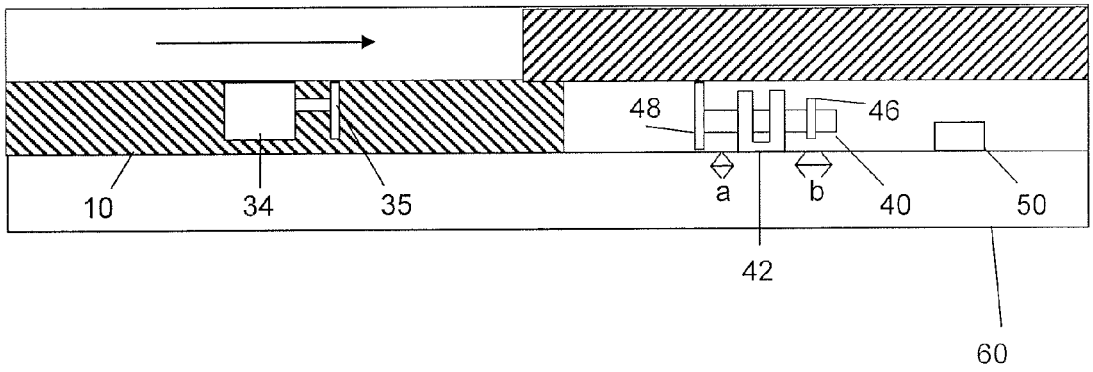
FIG. 2 is a top view of the door panel and hold open assembly of FIG. 1.

Base assembly 40 is generally fixedly mounted by any means for mounting, such as screwing, bolting, joining, adhering, pressing, soldering, and welding, as examples, by way of bracket 42. In one of more embodiments, bracket 42 includes one or more slots 47 for placement of fasteners. Base unit 40 may be mounted to a structure, Z (FIG. 7), such as a wall, track, header/footer or frame, when included, or other suitable feature incorporated with the sliding door assembly, such that, when mounted, a side view of the hold open unit is visible from a top viewing, such as illustrated in FIGS. 2 and 4. As depicted in FIGS. 1-4, the hold open assembly 8 and stop 50 are located at the upper end of sliding door panel 10. This assembly, however, may fully function at alternative locations, such as a lower end of the sliding door panel 10 or on the side, if sliding occurs in a vertical or angled direction. By positioning floating plate 35 on door panel 10 in a common trajectory with the base assembly 40, and more particularly, floating plate 48, when door panel 10 is in the fully open position, floating plates 35 and 48 are magnetically attracted to each other. The selected materials should be such that the two plates are releasable when a user pulls the door panel in the opposing direction allowing the door panel to close freely.

Furthermore, base assembly 40 may be of any suitable dimension such that the features described above are met. In one or more embodiments, as illustrated with FIG. 7, the piston length (L) may be about 2 inches, the bracket (B) may be about 1 inch wide and the distance (H) from the mounted structure (Z) to the midline of the piston (M) is about 0.63 inches. The floating plates may have a width or cross sectional diameter of about 1.4 inches or 1.75 inches or variations thereof, when circular. Other shapes (square, polygonal, etc.) may also be applied with the floating plates described herein. Generally, floating plate 48 is made of a magnetic material that has a pull, such as up to about 10 pounds, or about 13 pounds, or about 20 pounds or about 25 pounds, as examples. In one or more forms, a floating end is a disc magnet. In additional forms, a floating plate 48 is a ceramic pot or round magnet with a center hole (e.g., McMaster-Carr No. 5685 K26). Optionally, floating plate 48 is made of a material or composite material that exhibits a magnetic interaction in the presence of a field. For example, floating plate 48 may be an electromagnet (e.g., with a wire coiled around a metal core). A current drawn through the wire will develop a sufficient magnetic field to hold the door open and may be released to allow the door to close freely.

Referring back to FIGS. 1-3, door stop 50 is utilized to limit door travel thereby preventing potential damage to door 10 and/or hold open assembly 8 (i.e., breaking, cracking, bending, or dislodging of floating plates 35 and/or 48 or bracket 42). In particular, stop 50 is positioned so that when door 50 is fully opened as illustrated in FIGS. 3 and 4, floating plate 48 remains spaced apart from bracket 42. Thus, in one form, the assembly is designed such that floating plate 48 will not seat against or contact base assembly 40 when door 10 is in the fully open position. Preferably, base assembly 40 is mounted at a position allowing contact between floating plates 35 and 48 just prior to or when leading edge 12 contacts stop 50. Accordingly, if door 10 is further transitioned to the open position after contact between floating plates 35 and 38, piston 44 moves in the direction of arrow 45B thereby reducing the distance between the floating plate 48 and bracket 42 and increasing the distance between retainer ring 46 and bracket 42 until leading edge 12 contacts stop 50.

Figure 9:
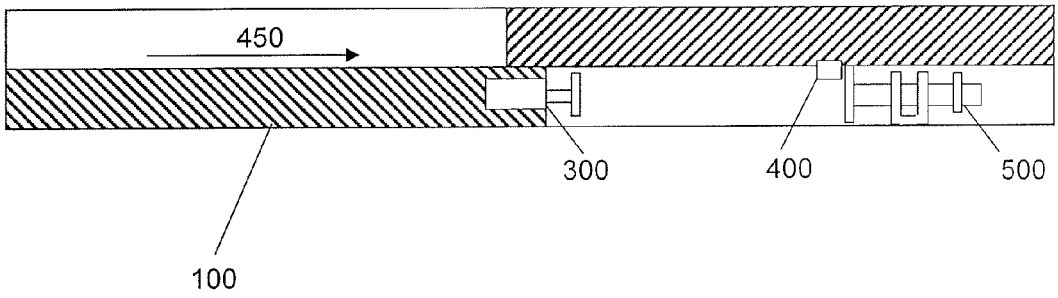
FIG. 9 is a top view of another representative door panel and hold open assembly, with door panels in the closed position.
Figure 10:
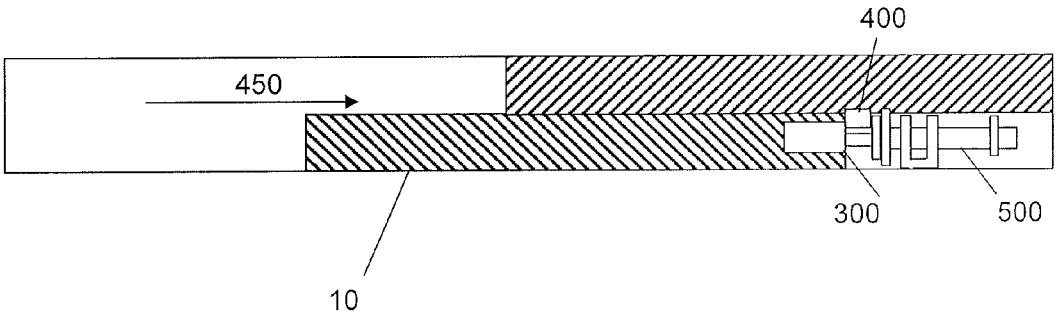
FIG. 10 is a top view of the representative door panel and hold open assembly of FIG. 9 with a door panel in the open position.

An alternative configuration is depicted in FIGS. 9 and 10 in which floating plate 300 is positioned generally at an end of the leading edge of a door panel 100. Operationally, this door panel and assembly functions similarly to that previously described. Thus, when door panel 100 is slideably moved from a closed position in FIG. 9 to an open position in FIG. 10, floating plate 300 will contact hold open unit 500 and the leading edge of door panel 100 will simultaneously or shortly thereafter contact stop 400. Said contacts will prevent further movement of door panel 100 in the direction of the arrow 450 in FIG. 10 and damaging contact to hold open assembly 8.

The slideable movement of piston 44 and the pivotable mounting of floating plates 35 and 48 allow for a flexible, non-rigid and slideable engagement between floating plates 35 and 48. This minimizes potential damage to hold open assembly 40 offers a mechanism with less rigidity and more yield as compared with prior assemblies. Moreover, as depicted herein, hold open assembly is not the only stop mechanism when the door moves from a closed to an open position. Stop 50 is appropriately positioned to contact leading edge 12 of the door and to minimize contact between the magnetic element and the bracket of the hold open unit, thus, preventing undue damage to the magnetic element as well as to the hold open unit and floating plate.

Although representative processes and articles have been described in detail herein, those skilled in the art will recognize that various substitutions and modifications may be made without departing from the scope and spirit of the invention as described and defined by the appended claims.

What is claimed is:

1. An assembly for holding a sliding door panel in an open position, the assembly comprising:

a first base having a sliding component extendible and retractable relative to the first base, one end of the sliding component supporting a first pivoting element secured to the one end, and pivots about said one end, during the operation of the assembly the first base configured to securely fasten, and remain stationary relative to the sliding door during operation; and a second base having a second pivoting element extending from the second base and pivoting with respect to the second base, the second base further configured to secure to the sliding door panel in a fixed position such that the second base is moveable with sliding action of the sliding door, the second pivoting element and the first pivoting element being aligned along a common axis to facilitate coupling of the first pivoting element of the first base to the second pivoting element of the second base when the sliding door panel is in a fully opened position, the sliding component of the first base extending and retracting relative to the first based along the common axis in response to movement of the sliding door panel from a closed position to the fully opened position.

2. The system of claim 1 further comprising a stop positioned along the common trajectory to contact a leading end of the sliding door panel when the sliding door panel is in the fully opened position and prevent direct contact between the first base and the first pivoting element.

3. The system of claim 1, further comprising a door stop positioned to prevent further movement of the leading end of the sliding door panel after coupling of the first and second pivoting elements.

4. The system of claim 1, wherein the first and second pivoting elements are magnetically attracted to each other.

5. The system of claim 1, wherein the first base comprises at least one opening to slideably receive a cylindrical piston movable therein, the first pivoting element disposed on an end of the cylindrical piston.

6. The system of claim 1, wherein the first pivoting element is a ceramic disc magnet.

7. The system of claim 1, wherein the second base comprises a slot to enable positional adjustment of the second pivoting element relative to the second base.

8. The system of claim 1, wherein the sliding component is mounted in an opening on the first base and comprises a cylindrical cross section.

9. A system for holding a door panel when in an open position, the system comprising:

a first base disposed in a fixed position adjacent to the door panel along a common path of the door panel, and having a sliding component extendible and retractable relative to the first base for moving relative to the first base, the sliding component comprising a first coupling element disposed on one end that pivots about the one end during the operation of the assembly;

a second base having a second coupling element secured thereto, the second base fixed to the door panel, and moving with the door panel along the common path, the second coupling element extending from the second base and positioned to be releasably cooperative with the first coupling element of the first base when the door panel is in a fully opened position, the sliding component of the first base positioned along a common axis with the second coupling element of the second base with respect to the common path; and a stop member positioned independent from the first base and the second base for contacting a leading edge of the door panel when the first and second coupling elements are secured together, such that the stop member prevents contact between the first base and the first coupling element.

10. The system of claim 9, wherein the first and second coupling elements are pivoting plates to facilitate flush engagement therebetween.

11. The system of claim 9, wherein the first base further comprises a bracket for supporting the sliding component for sliding movement.

12. The system of claim 9, wherein the second coupling element is magnetic.

13. The system of claim 9, wherein the first and second coupling elements are magnetically attracted to each other.

14. The system of claim 9, wherein the second base comprises an adjustment slot to enable positional adjustment of the second coupling element relative to the second base.

15. The system of claim 9, wherein the first coupling element comprises a ceramic disc magnet.

16. A method for holding a door panel, the method comprising:

providing a door panel having a leading edge and slideable along a common path;

positioning in a fixed location a first base adjacent the door panel and along the common path, the first base comprising a sliding component therein, the sliding component extendible and retractable relative to the first base, and in response to movement of the door panel, the sliding component further configured with a coupling element on one end that pivots about the one end during the operation of the assembly;

fixing a second base to the door panel in a position for movement with the door panel along the common path, the second base comprising a coupling element for releasable engagement with the first base coupling element when the door panel is in the open position; and positioning a stop member independent from the first base and the second base for contacting a portion of the leading edge of the door panel when the first base and the second base are coupled along the common path, thereby preventing contact between the first base coupling element and the first base.

17. The method of claim 16, wherein the first base is further configured with a bracket portion for supporting the sliding component.

18. The method of claim 16, wherein the first unit and second unit coupling elements are magnetically attracted to each other.

19. The method of claim 16, further comprising providing first base and second base pivoting plates as coupling elements to facilitate flush engagement therebetween.

20. The method of claim 16, further comprising providing an adjustment slot on the second base to enable positional adjustment of the coupling element of the second-unit relative to the second base.

21. The assembly of claim 1, wherein the sliding component further comprises a retaining ring at or near an end opposing the one end of the sliding component supporting the first pivoting element for preventing the sliding component from being released from the first base.

22. The assembly of claim 1, wherein pivoting by one or more of the first pivoting element and second pivoting element is provided by a slip joint.

23. The assembly of claim 1, wherein pivoting by one or more of the first pivoting element and second pivoting element is provided by a non-rigid securement of the one or more of the first and second pivoting element with respect to the first and second base, such that a gap remains around the one or more of the first and second pivoting element after the non-rigid securement.

* * * * *